US010123604B2

(12) United States Patent
Valkenhoff

(10) Patent No.: US 10,123,604 B2
(45) Date of Patent: Nov. 13, 2018

(54) LIGHTING DEVICES FOR PURSES AND BAGS

(71) Applicant: Donald Valkenhoff, Sacramento, CA (US)

(72) Inventor: Donald Valkenhoff, Sacramento, CA (US)

( * ) Notice: Subject to any disclaimer, the term of this patent is extended or adjusted under 35 U.S.C. 154(b) by 119 days.

(21) Appl. No.: 15/210,800

(22) Filed: Jul. 14, 2016

(65) Prior Publication Data

US 2017/0049204 A1 Feb. 23, 2017

Related U.S. Application Data

(60) Provisional application No. 62/192,980, filed on Jul. 15, 2015.

(51) Int. Cl.

| | |
|---|---|
| ***A45C 15/06*** | (2006.01) |
| ***A45C 13/10*** | (2006.01) |
| ***F21V 23/04*** | (2006.01) |
| ***F21V 21/088*** | (2006.01) |
| ***F21V 21/08*** | (2006.01) |
| ***F21V 33/00*** | (2006.01) |
| ***F21L 4/00*** | (2006.01) |
| ***A45C 3/06*** | (2006.01) |
| *F21W 121/00* | (2006.01) |
| *F21W 131/30* | (2006.01) |

(52) U.S. Cl.

CPC ..... *A45C 15/06* (2013.01); *A45C 3/06* (2013.01); *A45C 13/1069* (2013.01); *F21L 4/00* (2013.01); *F21V 21/0808* (2013.01); *F21V 21/0885* (2013.01); *F21V 23/04* (2013.01); *F21V 23/0414* (2013.01); *F21V 33/0004* (2013.01); *F21V 33/0008* (2013.01); *F21W 2121/00* (2013.01); *F21W 2131/30* (2013.01)

(58) Field of Classification Search

CPC ..... A45C 3/06; A45C 15/06; A45C 13/1069; F21L 4/00

See application file for complete search history.

(56) References Cited

U.S. PATENT DOCUMENTS

| | | | | |
|---|---|---|---|---|
| 6,082,867 | A * | 7/2000 | Chien | A43B 1/0072 313/512 |
| 6,120,162 | A * | 9/2000 | Guerrieri | A45C 15/06 362/155 |
| 9,144,282 | B2 | 9/2015 | Leuty | |
| 2012/0212940 | A1 | 8/2012 | Leuty | |
| 2015/0345759 | A1 * | 12/2015 | Gazlay | F21V 21/08 362/190 |

* cited by examiner

*Primary Examiner* — Anh Mai
*Assistant Examiner* — Nathaniel Lee
(74) *Attorney, Agent, or Firm* — Dergosits & Noah LLP

(57) ABSTRACT

A lighting system is disclosed for illuminating a container, such as a purse or bag. In an embodiment, the opening of the container causes a magnet to move away from a magnetic switch, which closes a circuit and activates a light that illuminates the interior of the container. In an embodiment, a magnetic switch, light, and battery may be incorporated into a detachable unit that is attached to one side of the opening of a container. A second magnetic detachable unit attached to the other side of the opening may cooperate with the first unit to activate the light when the container is opened.

18 Claims, 10 Drawing Sheets

LIGHTING DEVICES FOR PURSES AND BAGS

CROSS REFERENCE TO RELATED APPLICATIONS

This patent application claims priority to U.S. provisional patent application 62/192,980, filed Jul. 15, 2015, which is incorporated by reference.

TECHNICAL FIELD

The present invention relates to the field of lighting systems, and more particularly to lighting systems for illuminating the interiors of containers, such as purses or bags, upon the opening of the container.

BACKGROUND OF THE INVENTION

Containers, such as purses or bags, are built for holding things in an interior compartment. Containers may typically be closed and opened. The act of opening a container may indicate that a user wishes to view the contents of the container. But the contents of the container may be difficult to view for a number of reasons. For example: containers may be opened in dark areas; the container itself may put the contents in shadow; and contents of the container may put other contents in shadow. For such reasons a system is needed for illuminating the interior of containers.

BRIEF SUMMARY

In an embodiment, when the opening to a container, such as a purse or bag, is parted the separation causes a magnet on one side of the opening to separate from a magnetic switch on the other side of the opening. The separation of the magnet from the magnetic switch activates a light that illuminates the interior of the container. In an embodiment, the light may be a one or more light-emitting diodes. In an embodiment, the light may be one or more light-emitting diodes positioned near the base of the container, while the magnet and magnetic switch are positioned near the opening of the container.

In an embodiment, when a wallet is unfolded the separation of one side of the wallet from the other side causes a magnet on one side to separate from a magnetic switch on the other side. The separation of the magnet from the magnetic switch toggles the switch (i.e., changes the state of the switch from "on" to "off" or vice versa, which in this instance means the switch closes and completes the circuit) and activates a light that illuminates the interior of the wallet. In an embodiment, the light may be a light-emitting diode that illuminates the "card" section of the wallet. In an embodiment, the light may be a light-emitting diode that illuminates the "bill" section of the wallet.

In an embodiment, a magnetic switch, light, and battery may be incorporated into a lighting unit that may be used in multiple applications, including the opening of a container. In an embodiment, a lighting unit may be attached to one side of an opening and positioned to interact with a magnet attached on the other side of the opening. In the embodiment, parting the opening causes the magnet to separate from the magnetic switch on the lighting unit with the separation of the magnet from the magnetic switch toggling the switch and activating the light. In an embodiment, the lighting unit may be attached to the container by a clamp, a pin, or by a section of adhesive tape.

In an embodiment, a lighting unit may be equipped with a magnet positioned such that the magnet does not influence a magnetic switch within the lighting unit. Two such magnet-equipped illuminated units may be attached to an opening, one to each side. The two magnet-equipped lighting units may be oriented so that the proximity of the magnet from one unit toggles the magnetic switch from the other unit. The two units may then cooperate so that each illuminates upon being parted from the other.

Other objects, features, and advantages of the present invention will become apparent upon consideration of the following detailed description and the accompanying drawings, in which like reference designations represent like features throughout the figures.

DETAILED DESCRIPTION

Embodiments provide systems for illuminating containers. When the opening to a container, such as a purse or bag, is parted the separation causes a magnetic switch to activate a light. The light may be positioned to illuminate the interior of the container.

Figure 1:
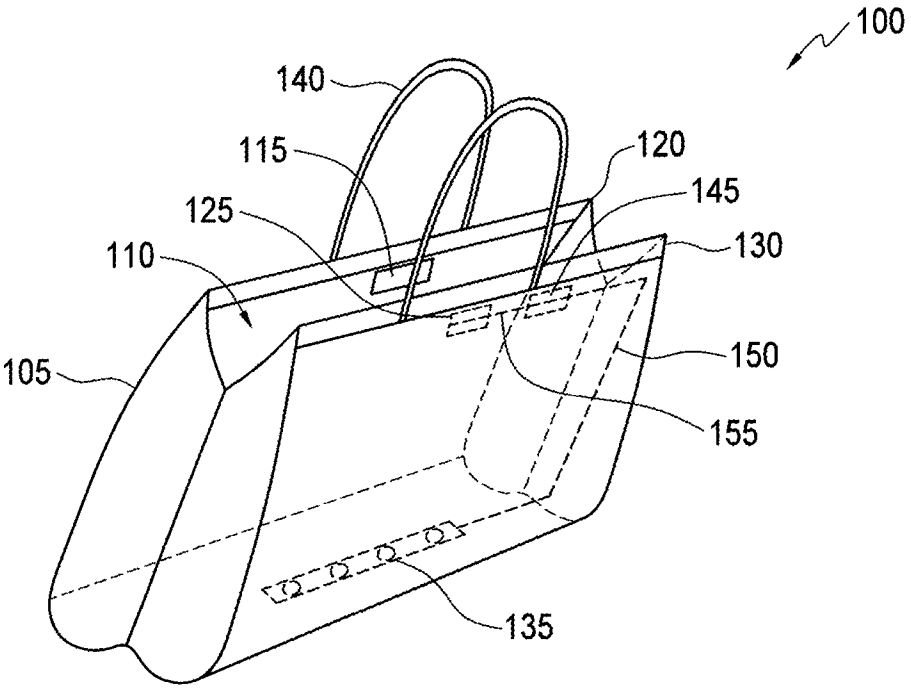
FIG. 1 shows a perspective drawing of an embodiment of a lighting system for illuminating a container, where the container is a purse, handbag, or luggage.

FIG. 1 shows a perspective drawing of an embodiment of a lighting system 100 for illuminating a container 105, where the container is, for example, a purse, handbag, or luggage. In FIG. 1, when an opening 110 to container 105 is parted the separation causes a magnet 115 on a first side 120 of opening 110 to separate from a magnetic switch 125 on a second side 130 of opening 110. The separation of magnet 115 from magnetic switch 125 activates a light 135 that illuminates the interior of container 105. In the embodiment, light 135 may be a series of light-emitting diodes positioned near the base of the container. But light 135 may be any type of suitable light, and may be positioned elsewhere within container, according to the choices of the designer. Light 135 may even be positioned externally to container 105, such that light 135 may illuminate the interior of container 105 from without. For example, light 135 may be attached to a handle 140 and oriented to illuminate the interior of container 105. Similarly, batteries 145 (or battery) may be positioned arbitrarily within container 105 according to the choices of the designer. Wiring 150, 155 for connecting light 135, batteries 145, and magnetic switch 125 may also be routed arbitrarily between the necessary components.

In an embodiment, the signal from magnetic switch 125 may be transmitted wirelessly from a wireless transmitting unit (not shown) to a wireless receiving unit (not shown). The receiving unit may be connected to light 135 so that the signal from magnetic switch 125 activates light 135. In the embodiment, light 135 and the wireless transmitting and receiving units may be powered by separate batteries (not shown).

In an embodiment, the container may be a drawer, for example, a sock-drawer in a dresser. In the embodiment, a magnetic switch, light, battery, and wiring may be contained in a stationary section of the container, e.g., the dresser, with the magnet positioned in the section of the container to be opened, e.g., the drawer. In the embodiment, the opening of the drawer separates the magnet from the magnetic switch and thereby activates the light that may be positioned to illuminate the contents of the drawer.

Figure 2:
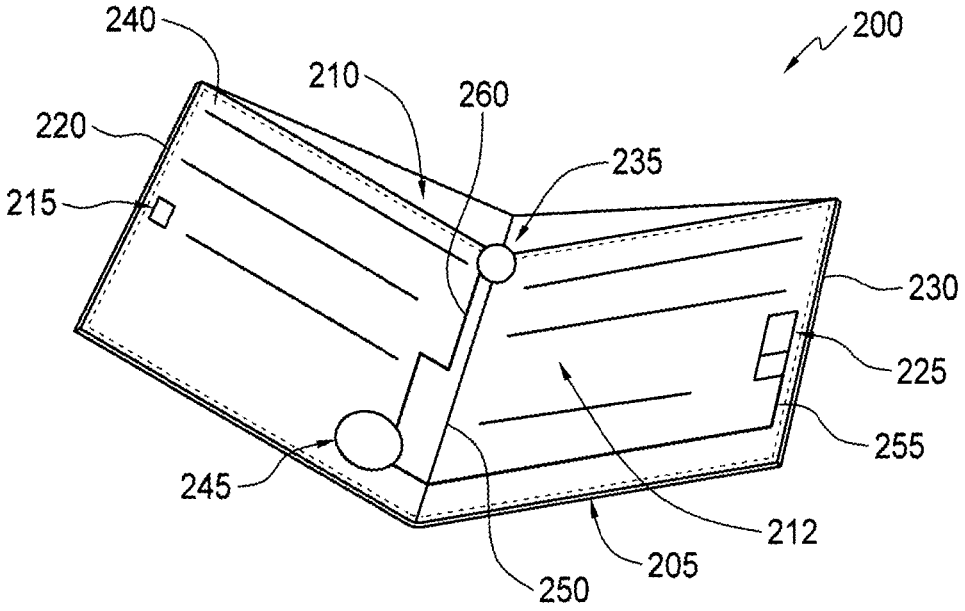
FIG. 2 shows a perspective drawing of an embodiment of a lighting system for illuminating a container, where the container is a wallet.

FIG. 2 shows a perspective drawing of an embodiment of a lighting system 200 for illuminating a container, where the container is, for example, a wallet 205. In FIG. 2, when wallet 205 is unfolded the separation of a first side 220 of the wallet from a second side 230 causes a magnet 215 on first side 220 to separate from a magnetic switch 225 on second side 230. The separation of magnet 215 from magnetic switch 225 activates a light 235 that illuminates the interior sections 210, 212 of the wallet. In an embodiment, light 235 may be a light-emitting diode oriented to illuminate a "card" section 212 of wallet 205. In an embodiment, light 235 may be a light-emitting diode oriented to illuminate a "bill" section 210 of the wallet.

Similar to FIG. 1, in the embodiment of FIG. 2, light 235 may be a single light-emitting diode positioned near a crease 250 of wallet 205. But light 235 may be any type of suitable light, and may positioned elsewhere within or on wallet 205, according to the choices of the designer. Light 235 may even be positioned externally to wallet 205, such that light 235 illuminates the interior of wallet 205 from without. For example, light 235 may be attached to a corner 240 and oriented to illuminate the interior of wallet 205. Similarly, batteries 245 (or battery) may be positioned arbitrarily within wallet 205 according to the choices of the designer. Wiring 255, 260 for connecting light 235, batteries 245, and magnetic switch 225 may also be routed arbitrarily between the necessary components.

In an embodiment, the signal from magnetic switch 225 may be transmitted wirelessly from a wireless transmitting unit (not shown) to a wireless receiving unit (not shown). The receiving unit may be connected to light 235 so that the signal from the magnetic switch 225 activates light 235. In the embodiment, light 235 and the wireless transmitting and receiving units may be powered by separate batteries (not shown).

Figure 3:
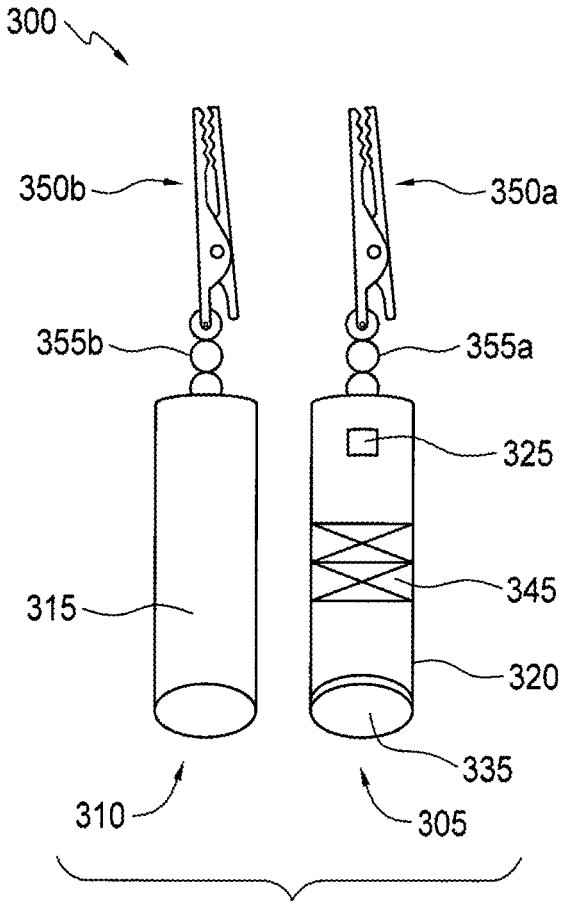
FIG. 3 shows a perspective drawing of an embodiment of a lighting system for multiple lighting applications.

FIG. 3 shows a three-dimensional drawing of an embodiment of a lighting system 300 for illuminating multiple applications, including, for example, a container. In FIG. 3, a magnetic switch 325, light 335, and battery (or batteries) 345 may be incorporated into a lighting unit 305 that may be attached to the opening of a container (not shown). In an embodiment, lighting unit 305 may be attached to a first side of the container opening and a magnetic unit 310 may be attached to a second side of the container opening. Magnetic unit 310 may be equipped with a magnet 315 for interacting with magnetic switch 325 as described earlier. Lighting unit 305 and magnetic unit 310 may be positioned about the opening so that parting the opening causes magnetic switch 325 to activate light 335. The parting may cause magnet 315 to separate a threshold distance from magnetic switch 325 with the separation causing magnetic switch 325 to toggle (i.e., complete the circuit between light 335 and battery 345), activating light 335 in lighting unit 305. Light 335 may then illuminate the interior of the container. In an embodiment, lighting unit 305 and magnetic unit 310 may be attached by clamps 350*a*, 350*b* respectively. In an embodiment, clamps 350*a*, 350*b* may be connected by flexible connectors 355*a*, 355*b* to lighting unit 305 or magnetic unit 310, respectively, but clamps 350*a*, 350*b* may also be more rigidly connected to units 305, 310, so that, by positioning clamps 350*a*, 350*b* as desired, a user may exert more control over the positions of units 305, 310. Such control may result in improving the toggling of magnetic switch 325 in response to motion of magnet 315, and may also direct more of the light from lighting unit 305 on a desired area.

In an embodiment, a lighting unit 305 as described above with respect to FIG. 3 may be equipped with a magnet. The magnet on the unit may be positioned so as not to interfere with the magnetic switch 325 on that same unit. Then, a first such magnet-equipped lighting unit may be oriented 180 degrees from a second such magnet-equipped lighting unit so that the magnet from the first unit activates the magnetic switch of the second unit. In this manner, the magnet on one unit may be used to activate the magnetic switch on the other unit, and vice-versa. Two such magnet-equipped illuminated units may be attached to an opening, one to each side. The two magnet-equipped lighting units may then cooperate so that each illuminates upon being parted from the other. In other words, with two magnet-equipped lighting units, the first magnetic switch may assume a conducting state turning on the light when the second magnetic unit is beyond a threshold distance from the first magnetic switch and may assume a non-conducting state when the second magnetic unit is within the threshold distance. Similarly, the second magnetic switch may assume a conducting state when the first magnetic unit is beyond the threshold distance from the second magnetic switch and may assume a non-conducting state when the first magnetic unit is within the threshold distance.

Figure 4:
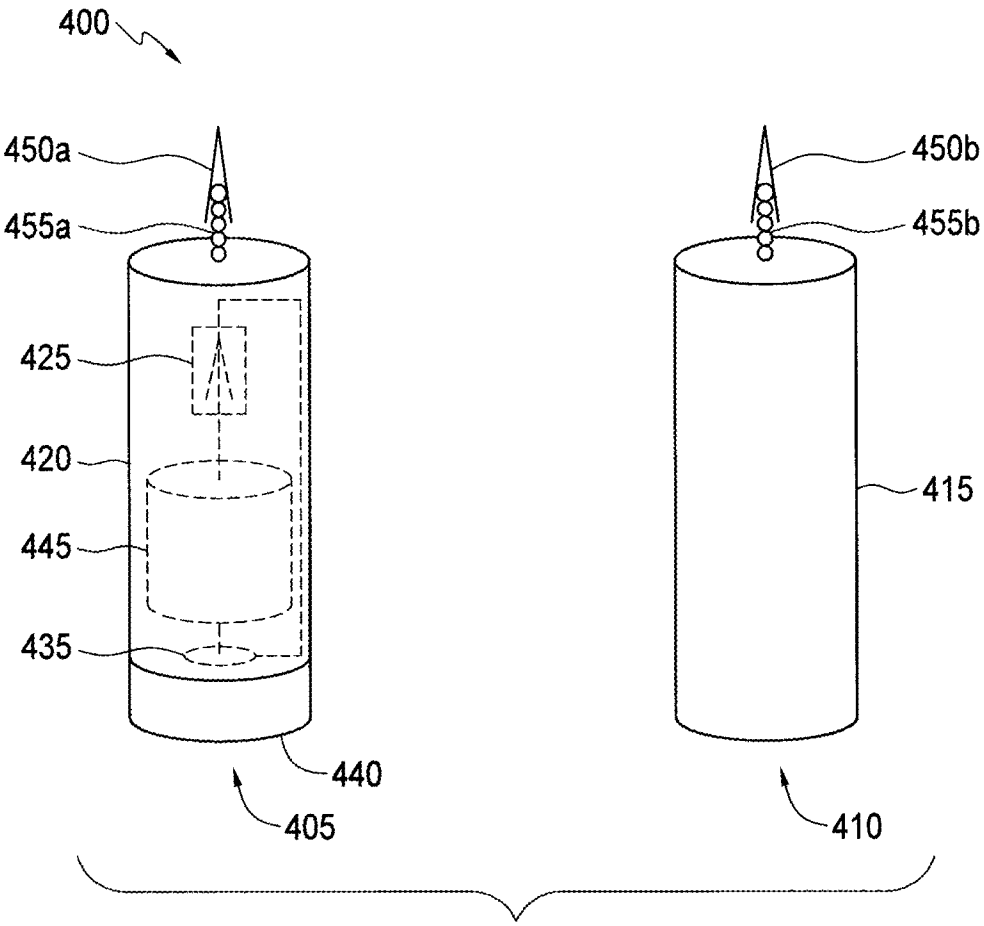
FIG. 4 shows a perspective drawing of an embodiment of a lighting system for multiple lighting applications.

FIG. 4 shows a perspective drawing of an embodiment of a lighting system 400 for multiple illuminating applications, including, for example, a container such as purse 105 (FIG. 1). In FIG. 4, a magnetic switch 425, light 435, and battery (or batteries) 445 may be incorporated into a lighting unit 405 that may be attached to the opening of a container (e.g., purse 500, FIG. 5). In an embodiment, magnetic switch 425 may include, for example, a reed switch, a Hall Effect sensor-based switch, or a magneto-resistive sensor-based switch. Lighting unit 405 may include a housing 420 for housing magnetic switch 425, battery 445, and light 435. Unit 405 may include a lens 440, which may protect light 435, or may focus or diffuse the light from light 435, or both. In an embodiment, lighting unit 405 may be attached to a first side of the container opening and a magnetic unit 410 may be attached to a second side of the container opening. Magnetic unit 410 may be equipped with a magnet 415 for interacting with magnetic switch 425 as described earlier. Lighting unit 405 and magnetic unit 410 may be positioned about the opening so that parting the opening causes magnetic switch 425 to activate light 435 in the following manner. The parting may cause magnet 415 to separate a threshold distance from magnetic switch 425 with the separation causing magnetic switch 425 to toggle (i.e., complete the circuit between light 435 and battery 445), activating light 435. Light 435 may then illuminate the interior of the container. In an embodiment, lighting unit 405 and magnetic unit 410 may be attached by fasteners 450*a*, 450*b* respectively. In an embodiment, fasteners 450*a*, 450*b* are connected by flexible connectors 455*a*, 455*b* to lighting unit 405 and magnetic unit 410, respectively, but fasteners 450*a*, 450*b* may also be more rigidly connected to units 405, 410, so that, by positioning fasteners 450*a*, 450*b* as desired, a user may exert more control over the positions of units 405, 410. Such control may improve the toggling of magnetic switch 425 in response to motion of magnet 415, and such control may also direct more of the light from lighting unit 405 on a desired area.

In an embodiment, fasteners 450*a*, 450*b* may be, for example, snaps, clamps, buttons, or pins (such as bobby pins or safety pins), and used to attach units 405, 410 to a container, such as a purse. Clamps may be more effective where the container has a conveniently-placed edge, while pins may be more effective where the container has a surface that may be easily pierced. In an embodiment, tabs (not shown) may be taped or glued to a container and fasteners 450*a*, 450*b* may attach to the tabs so that units 405, 410 may be attached to the container. For example, the tabs may be a quarter of an inch square and a sixteenth of an inch thick with adhesive tape for attaching the tab to the container. In an embodiment, fasteners 450*a*, 450*b* may be sections of adhesive tape. It should be realized that different fasteners may be preferable, depending on the material and geometry of the item to be fastened to, and that different fasteners may be used without departing from the claimed subject matter.

In an embodiment, additional fasteners may be added to lighting unit 405 and magnetic unit 415 to reduce the movement of units 405, 415 with respect to a container to which they are mounted. For example, with regard to FIG. 4, lighting unit 405 could have a second fastener attached at the end opposite of fastener 450*a*. That is, lens 440 may have a fastener for attaching to the container. With both fastener 450*a* and the fastener near lens 440 attached to a container, lighting unit 405 would be restricted in movement with respect to the container. Such restriction may be beneficial in, for example, keeping lighting unit 405 protected, or keeping lighting unit 405 in a preferred orientation for interacting with magnetic unit 415. Similarly, magnetic unit 415 may have an additional fastener (not shown) at the end opposite fastener 450*b*, which when fastened, may be beneficial by keeping magnetic unit 415 protected, or by keeping magnetic unit 415 in a preferred orientation for interacting with lighting unit 405.

In an embodiment, housing 420 may be of a first color and a shell (not shown) may be of a second color and configured to slide over housing 420 so that the apparent color of lighting unit 405 may be changed. A number of shells of different appearance may be supplied with lighting unit 405, providing options for a user to adjust the appearance of lighting unit 405. For example, shells may have different colors, textures, patterns, and shapes. Also, shells may not cover the entirety of housing 420, or may appear to increase the size of housing 420. Similarly, shells of different appearance may be supplied with magnetic unit 415 to alter its appearance. In an embodiment, units 405, 410 may be supplied with such shells already installed, giving the user the ability to change the appearance of units 405, 410 by simply removing the shell. In an embodiment, units 405, 410 are similar enough in shape that a shell may fit either.

As shown in FIG. 4, units 405, 410 may be substantially cylindrical in shape, with any associated shells also being substantially cylindrical. However, in an embodiment, units 405, 410 may be arbitrarily shaped, so long as the arbitrary shape does not prevent magnet 415 from causing magnetic switch 425 to toggle depending on the relative locations of magnet 415 and magnetic switch 425. For example, in an embodiment, lighting unit 405 and magnetic unit 415 may be substantially flat on one side with the flat section provided with an adhesive so that units 405, 415 may be attached to a container by the adhesive rather than, or in addition to, fasteners 450*a*, 450*b*. In an embodiment, the adhesive may be an adhesive tape, or glue. In an embodiment with such a flat section and adhesive, fasteners 450*a*, 450*b* and flexible connectors 455*a*, 455*b* may not be attached and may be supplied separately.

In an embodiment, a shell may cover some, but not all of a unit 405, 410. In an embodiment, a shell may fit about a unit 405, 410, but may be shaped differently from unit 405, 410. For example, a shell (not shown) that is triangular when viewed from the clamp end may fit over a unit 405, 410 that is substantially cylindrical.

In an embodiment, flexible connectors 455*a*, 455*b* allow fasteners 450*a*, 450*b* to flex relative to the majority of the unit. Flexible connectors 455*a*, 455*b* may be, for example, swivels, flexible cords or wires, or sections of chain.

In an embodiment, lighting unit 405 may itself be equipped with a magnet. The magnet on the unit may be positioned so as not to interfere with magnetic switch 425. For example, the magnet could be placed near the clamp end of unit 405 or at the light end of unit 405 and oriented so that the magnet did not activate magnetic switch 425 on the same unit. Then, a first such magnet-equipped lighting unit may be oriented 180 degrees from a second such magnet-equipped lighting unit so that the magnet from the first unit activates the magnetic switch of the second unit. In this manner, the magnet on one unit may be used to activate the magnetic switch on the other unit, and vice-versa. Two such magnet-equipped illuminated units may be attached to an opening, one to each side. The two magnet-equipped lighting units may then cooperate so that each illuminates upon being parted from the other.

In an embodiment, the threshold at which a magnetic switch toggles may be different depending on whether the magnetic unit is moving toward the magnetic switch, or away. In an embodiment, the difference may be due to hysteresis in the magnetic switch. In an embodiment, any difference in toggling threshold may be inconsequential, so that when describing the embodiment, a single threshold may be referenced regardless of whether the magnetic unit is moving toward or away from the magnetic switch.

In an embodiment, lighting system 400 may include a timer for turning off light 435 after a pre-determined time of, for example, 25 seconds. In the embodiment, the timer (not shown) would activate upon the magnetic switch 425 toggling and turning on light 435. After a pre-determined time, the timer would signal for, or control, a switch (not shown) to open, turning off light 435. In an embodiment, the pre-determined time may be set by the user. For example, a user with a larger container might wish light 435 to stay on longer than a user with a relatively small container. In an embodiment, the battery life of a lighting system might be enhanced by such a timer reducing the power lost due to undesired system activation. In an embodiment, the timer may be reset and the associated switch closed when magnetic switch 425 is toggled by bringing magnet 415 back to within a threshold distance.

Figure 5:
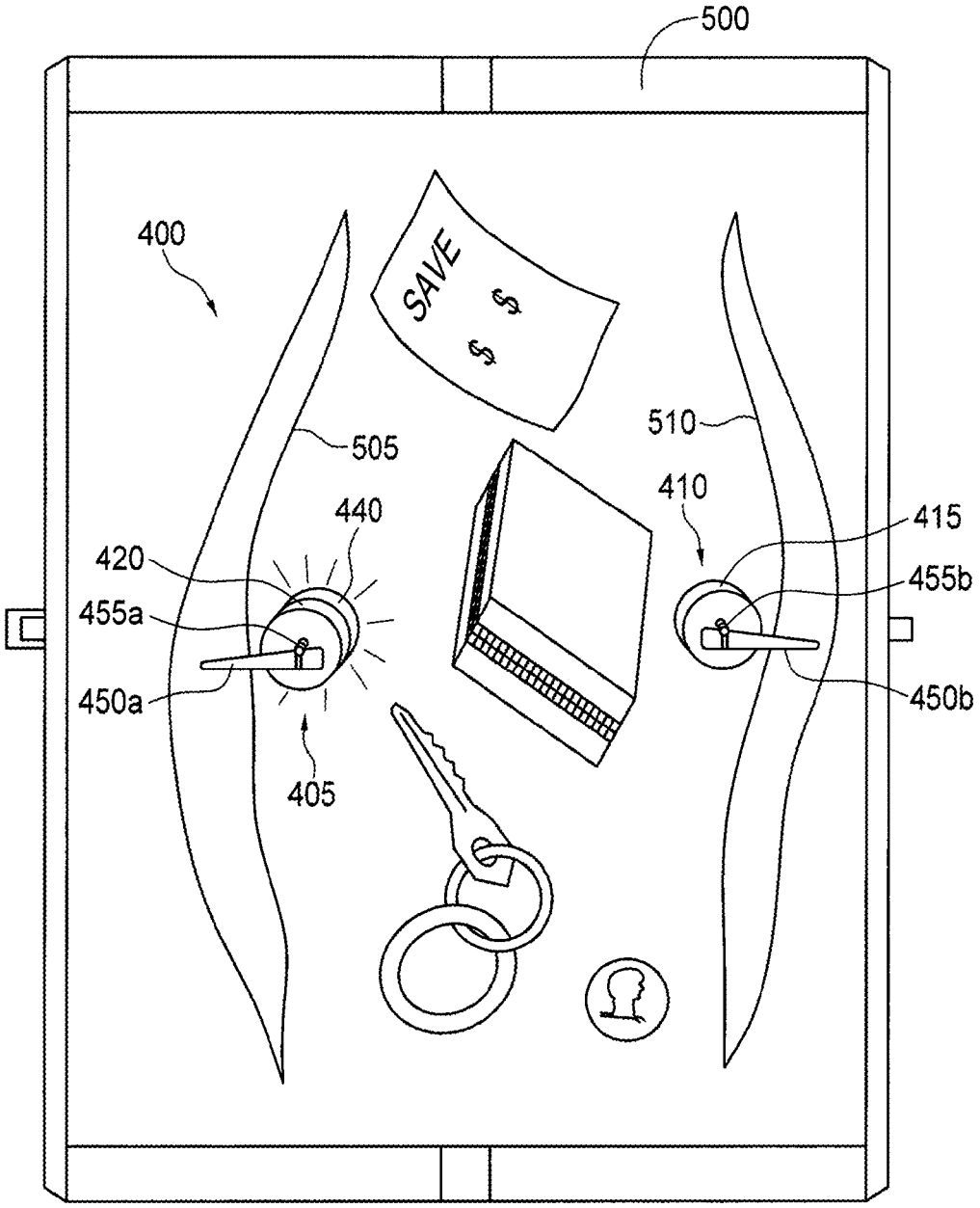
FIG. 5 shows a top view of a use of an embodiment of a lighting system.

FIG. 5 is a top view of a use of an embodiment of a lighting system 400. In FIG. 5, lighting system 400, using clamps as fasteners 450*a*, 450*b*, has been attached to a container, in this case a purse 500. Purse 500 is open and its interior and contents are being viewed from above. Lighting unit 405 has been clamped to the lip of a pocket 505 using fastener 450*a* and magnetic unit 410 has been clamped to the lip of a pocket 510 on an opposing side of purse 500. Light is being provided through lens 440. When purse 500 is closed, pockets 505, 510 will be brought closer together. When magnetic unit 410 comes within a threshold distance from lighting unit 420, the magnetic switch 425 (FIG. 4) will toggle, causing light 435 (FIG. 4) to turn off. Conversely, when purse 500 is opened, pockets 505, 510 will become separated. When magnetic unit 410 passes a threshold distance from lighting unit 420, the magnetic switch 425 (FIG. 4) will toggle, causing light 435 to turn on, as is shown. As shown in FIG. 5, flexible connectors 455*a*, 455*b* allow unit 405, 410 to dangle, so that gravity may cause units 405, 410 to be similarly oriented when purse 500 is opened or closed. When units 405, 410 are similarly oriented the interaction between magnetic 415 and magnetic switch 425 may be more consistent.

In an embodiment, a second light may be added to a lighting unit. The second light may be connected using extension wiring that allows the second light to be separated from the majority of the lighting unit, yet still be controlled by the magnetic switch of the lighting unit. The extension wiring may allow the placement of the second light in a second place within the container to provide better illumination to a desired area. For example, using FIG. 5, lighting unit 405 may include a second light, with second light fastened to pocket 505 toward the top of the drawing from lighting unit 405. The second light, in the second location, may illuminate contents of purse 500 that would otherwise remain in shadow. In an embodiment, the second light and extension wiring may be reversibly connected to lighting unit 405 such that the second light may be added if desired by the user, or not, depending on the needs of the user. In an embodiment, the extension wiring may be covered by, attached to, or embedded in, adhesive tape that allows the extension wiring to be taped to the side of the container (e.g., pocket 505) and thereby kept neatly out of the way.

In an embodiment, a lighting system may include a kit with parts that may be used to augment, replace, or change parts of lighting system 400. For example, extra fasteners such as clamps, pins, and adhesive tape may be included. Tabs with adhesive for attaching to hard or flat surface may be included to give clamp or pin fasteners something to clasp or pierce. Similarly, shells of different color, shape, size, and texture, for example, may be included for changing the appearance of the lighting unit, or the magnetic unit, or both.

Figure 6:
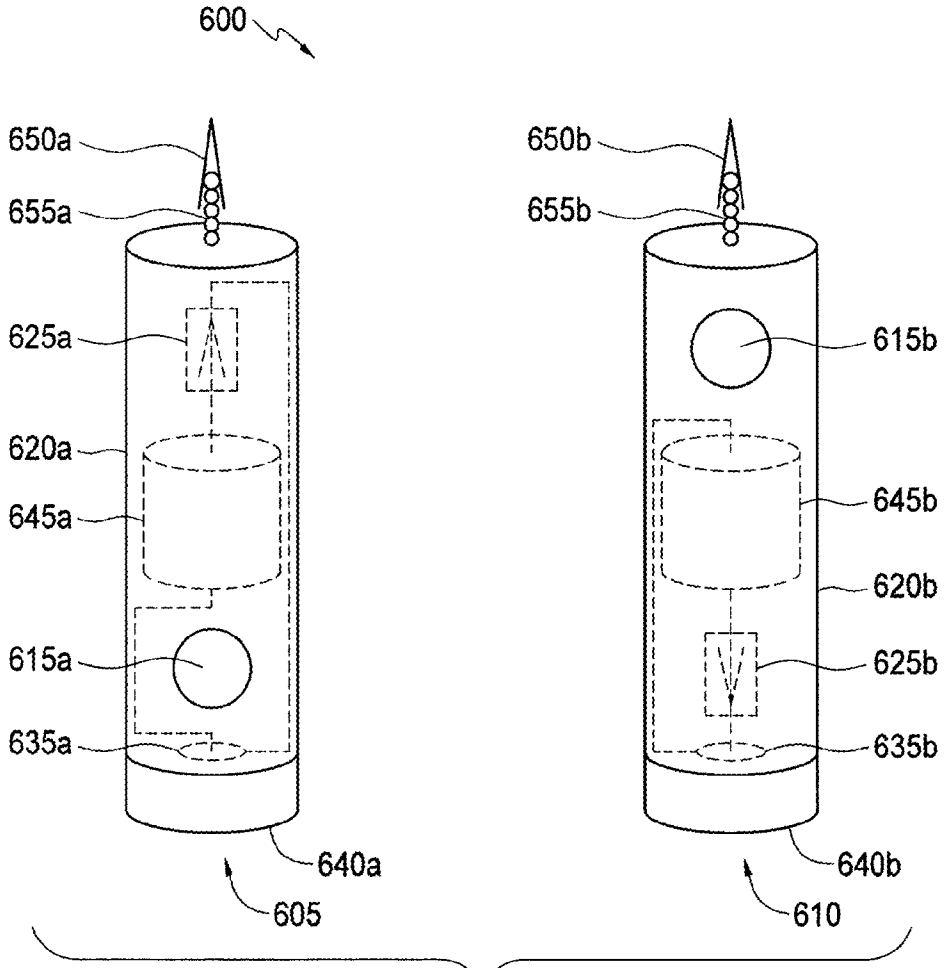
FIG. 6 shows a perspective drawing of an embodiment of a lighting system for multiple lighting applications.

FIG. 6 shows a perspective drawing of an embodiment of a lighting system 600 for multiple lighting applications. In FIG. 6, a lighting unit 605 may be equipped with a magnet 615*a* within a housing 620*a*, in addition to a magnetic switch 625*a*, a battery 645*a*, a light 635*a*, and a lens 640*a*. Magnet 615*a* may be positioned within lighting unit 605 so as not to interfere with magnetic switch 625*a*. As shown, magnet 615*a* is placed near the light end of unit 605 and oriented so that magnet 615*a* does not activate magnetic switch 625*a*. A fastener 650*a* and a flexible connector 655*a* provide for attaching lighting unit 605 to, for example, a lip of a container. A second lighting unit 610 may be equipped with a magnet 615*b* within a housing 620*b*, in addition to a magnetic switch 625*b*, a battery 645*b*, a light 635*b*, and a lens 640*b*. Magnet 615*b* may be positioned on lighting unit 610 so as not to interfere with magnetic switch 625*b*. As shown, magnet 615*b* is placed near the fastener end of unit 610 and oriented so that magnet 615*b* does not activate magnetic switch 625*b*. Lighting units 605, 510 thus have their magnets and magnetic switches oriented 180 degrees from the other so that magnet 645*a* from lighting unit 605 may activate magnetic switch 625*b* of lighting unit 610. Conversely, magnet 645*b* from lighting unit 610 may activate magnetic switch 625*a* of lighting unit 605. The two magnet-equipped illuminated units 605, 610 may be attached to an opening, for example, one to each pocket 505, 510 of purse 500 (FIG. 5.) The two magnet-equipped lighting units 605, 610 may then cooperate so that each illuminates upon being parted from the other.

Figure 7:
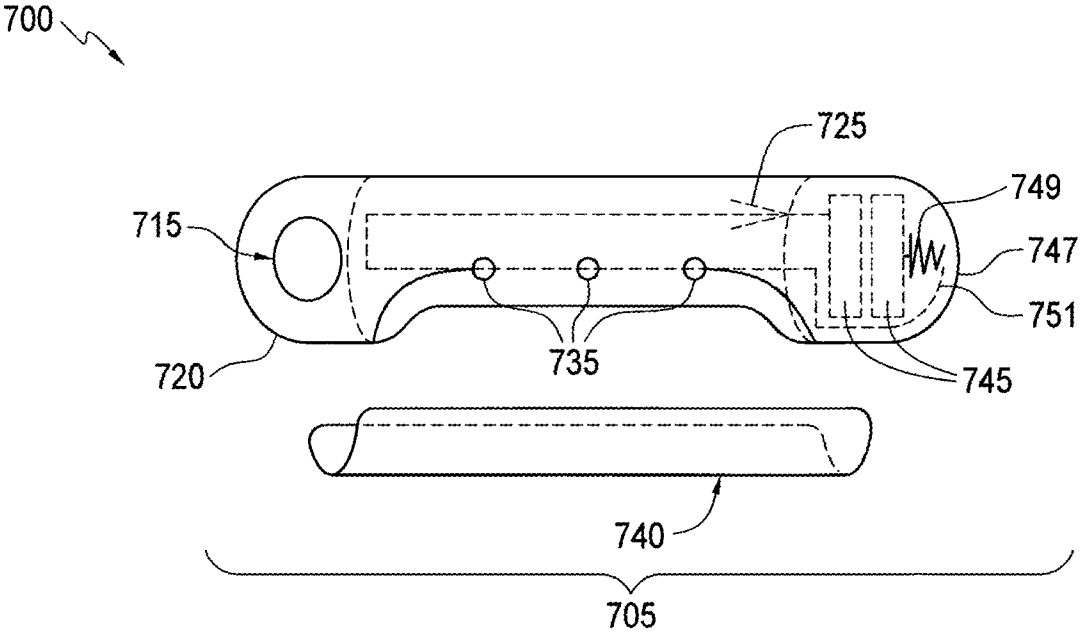
FIG. 7 shows a diagram of an embodiment of a lighting system for multiple lighting applications.

FIG. 7 shows a diagram of one half an embodiment of a lighting system 700 for multiple lighting applications. In FIG. 7, a lighting unit 705 may be equipped with a magnet 715 within a housing 720, in addition to a magnetic switch 725, batteries 745, LED lights 735, and a lens 740. Batteries 745 may be accessible via a screw top 747 equipped with a coil-spring 749 to stabilize and connect batteries 745 to circuitry 751. Lens 740 may be removable to allow changing to a different lens, one that, for example, has a focusing effect, a diffusing effect, or is of a different color. Magnet 715 may be positioned within lighting unit 705 so as not to interfere with magnetic switch 725. As shown, magnet 715 is placed near one end of unit 705 so that magnet 715 does not activate magnetic switch 725. A fastener 750 (not shown) and a flexible connector (not shown) may be used to attach lighting unit 705 to, for example, a lip of a container. In an embodiment, an adhesive or adhesive tape (not shown) may be applied to a section of housing 720 between magnet 715 and batteries 745 and opposite LEDs 735 and used to attach lighting unit 705 to a container, such as a purse. Lighting system 700 includes a second lighting unit 710 (not shown) that is similar to lighting unit 705. Lighting units 705, 710 may be reversed, i.e., have their magnets and magnetic switches oriented 180 degrees from each other so that magnet 745 from lighting unit 705 may activate the magnetic switch of lighting unit 710. Conversely, the magnet from lighting unit 710 may activate magnetic switch 725 of lighting unit 705. In an embodiment, each lighting unit 705, 710 is equipped with a timer that turns lights 735 off after a pre-determined time, for example, after 25 seconds, as described earlier with reference to FIG. 4.

Figure 8:
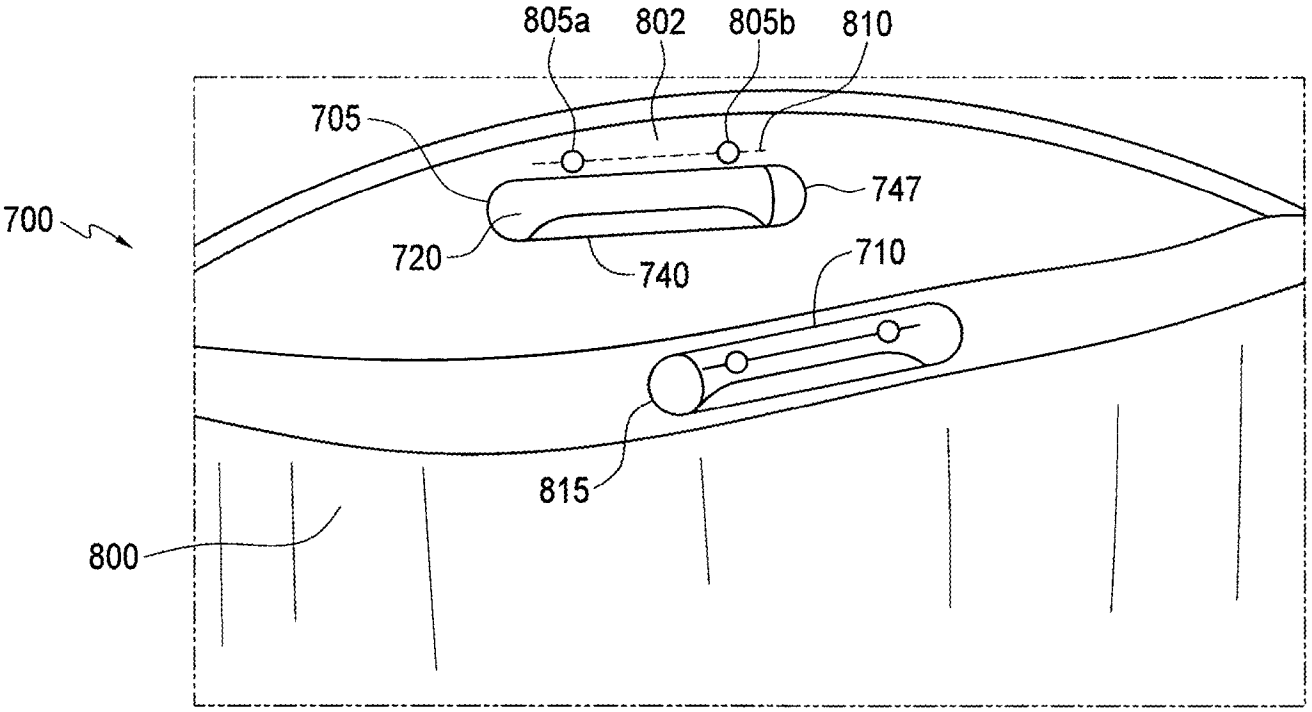
FIG. 8 shows a perspective view of a use of an embodiment of a lighting system.

FIG. 8 shows a perspective view of a use of lighting system 700. In FIG. 8, the two magnet-equipped lighting units 705, 710 are shown attached to a lining 802 in the interior of a purse 800. Lighting unit 710 is shown through a section of purse 800 that has been rendered transparent to more clearly display lighting unit 710. The placement of screw top 747 on lighting unit 705 and the placement of the screw top 815 on lighting unit 710 are indications that units 705, 710 are oriented so that the proximity of the magnet in lighting unit 705 affects the magnetic switch in lighting unit 710, and vice versa. In this orientation, the two magnet-equipped lighting units 705, 710 may interact so that each illuminates when the purse is opened and each turns off when the purse is closed. Lighting unit 705 may be attached to lining 802 using a pin 810 that has been passed through an eyelet 805*a*, into lining 802, and then through an eyelet 805*b*. With both lighting units 705, 710 so secured to purse 800 the orientation of lighting unit 705 with respect to lighting unit 710 may be maintained.

Figure 9A:
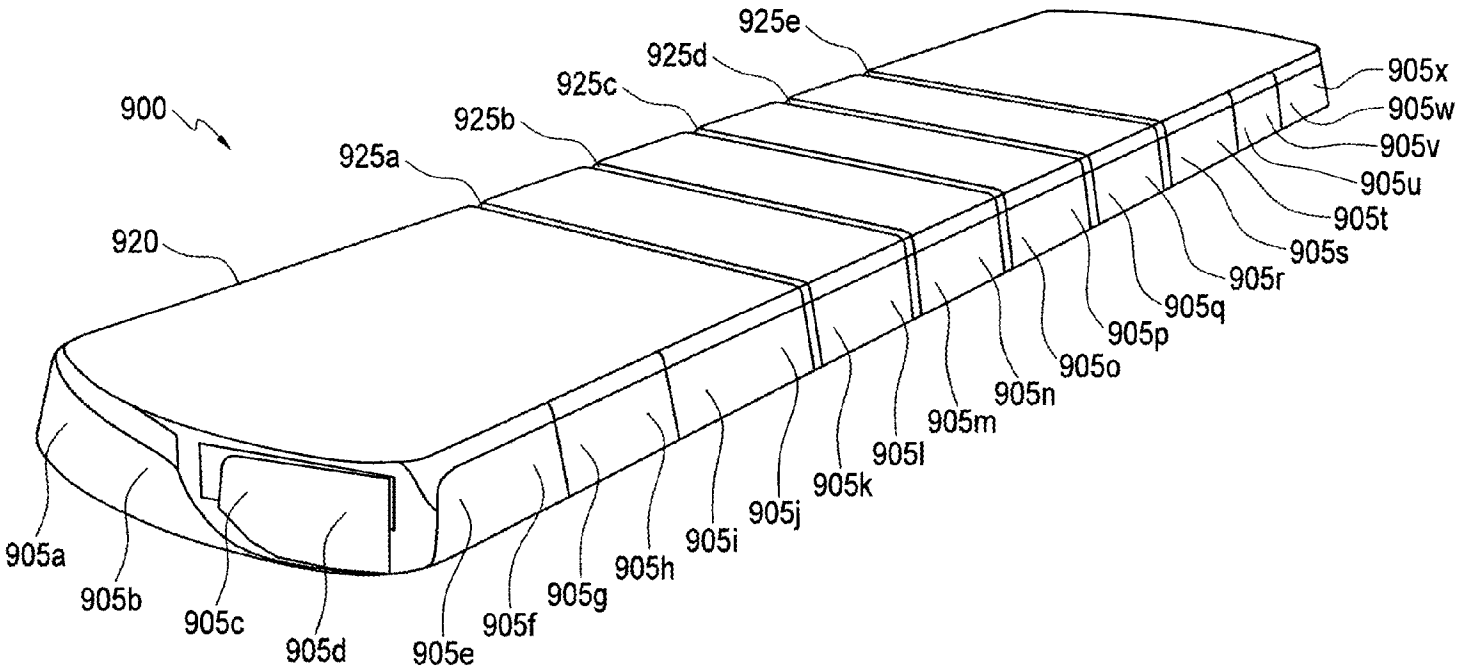
FIG. 9*a* shows a perspective view of an embodiment of a lighting unit for multiple lighting applications.
Figure 9B:
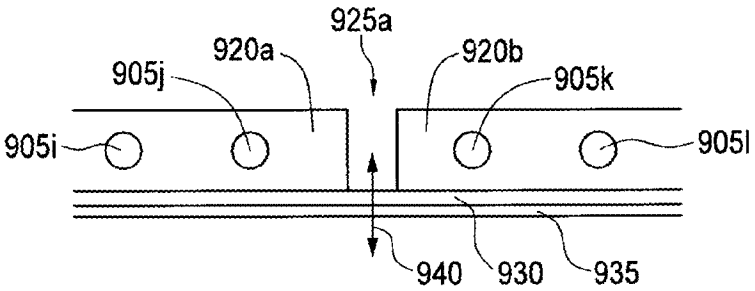
FIG. 9*b* shows a side view of a section of an embodiment of a lighting unit.

FIG. 9*a* shows a perspective view of a lighting unit 900 for multiple lighting applications. In FIG. 9, an articulated, flexible, transparent (or translucent) housing 920 houses multiple lights 905*a*, 905*b*, 905*c*, . . . , 905*x*, a magnetic switch (e.g., magnetic switch 725, FIG. 7), and battery (or batteries) (e.g., batteries 745, FIG. 7). Lights 905*a*-905*x* are arranged about an inner perimeter of housing 920. In an embodiment, lights 905*a*-905*x* may be arranged arbitrarily. For example, in an embodiment, lights 905*a*-905*x* may be uniformly dispersed within the interior of housing 920. In FIG. 9*a*, housing 920 has articulations 925*a*-925*e* that allow housing 920 to flex so that a base 930 may conform to a mounting surface. Base 930 may have an adhesive 935 (FIG. 9*b*, e.g., adhesive tape) for attaching to a mounting surface.

FIG. 9*b* shows a side view of a section of lighting unit 900. In FIG. 9*b*, articulation 925*a* includes a gap between housing sections 920*a*, 920*b* that allows base 930 to flex upward and downward (as shown by arrow 940). Downward flex results in sections 920*a*, 920*b* moving closer together and upward flex results in sections 920*a*, 920*b* moving further apart. Articulations 925*b*-925*e* are similar to articulation 925*a*. Articulations 925*a*-925*e* may allow housing 920 to conform to a surface and that conforming may improve the contact area of adhesive 935. In an embodiment, housing 920 may have more or fewer articulations, depending, for example, on the anticipated mounting surface and the flex that mounting surface may experience. The magnetic switch within lighting unit 900 may be activated based on the proximity to an external magnet, not shown. In an embodiment, the external magnet may include a magnet, such as that show in FIGS. 1-5. In an embodiment, lighting unit 900 may itself be equipped with a magnet and two such magnet-equipped units, properly oriented, may cooperate as discussed with reference to the magnet-equipped lighting units of FIGS. 6-8.

Figure 10:
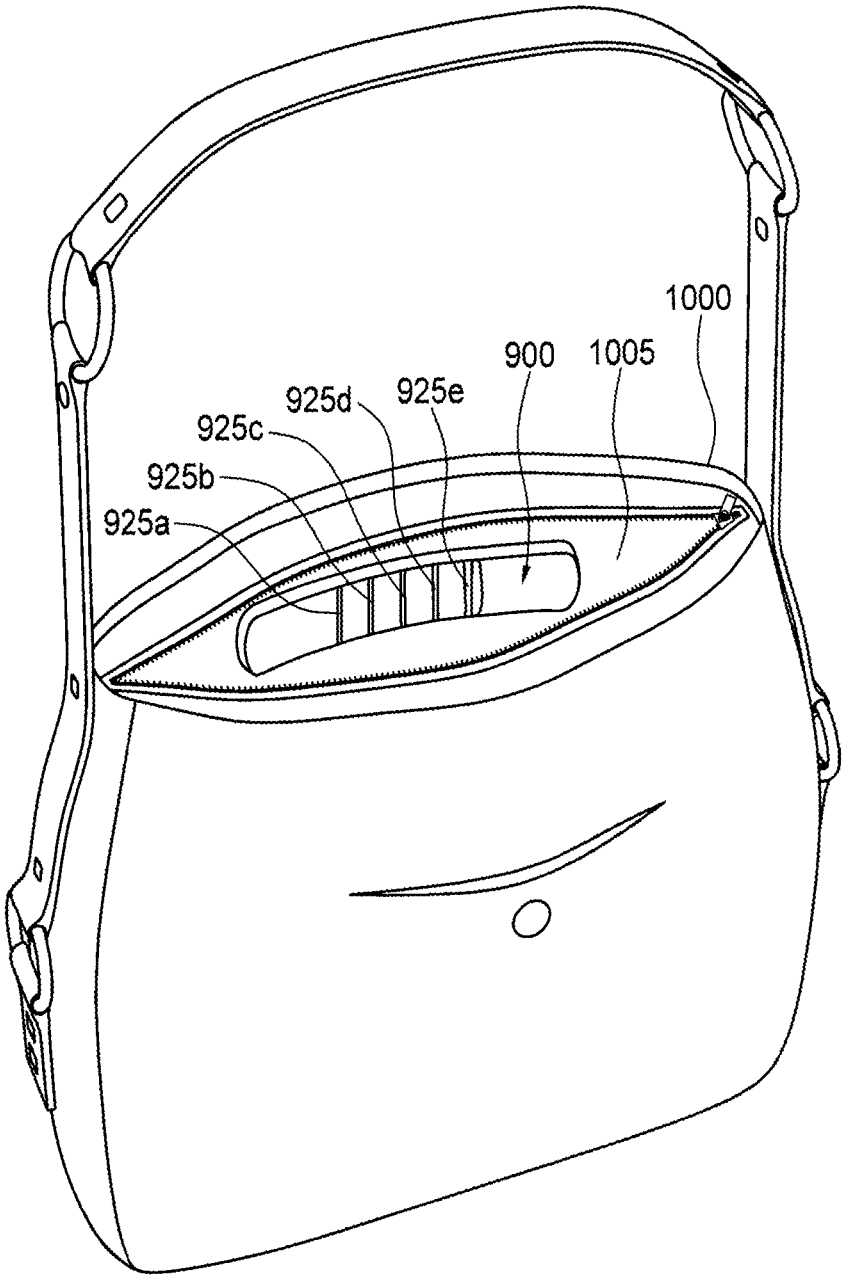
FIG. 10 shows a perspective view of a use of an embodiment of a lighting system.

FIG. 10 shows a perspective view of a use of lighting unit 900. In FIG. 10, lighting unit 900 has been attached by adhesive 935 (FIG. 9) to an inner lining 1005 of a purse 1000. A magnet (not shown) is attached to the opposing inner lining of purse 1000. With purse 1000 open, as shown, lighting unit 900 illuminates the interior. When purse 1000 is closed, lighting unit 900 will turn off when the magnet (not shown) comes within a certain distance from the magnetic switch within lighting unit 900. As shown, articulations 925*a*-925*e* have allowed lighting unit 900 to bend and conform to the curve of inner lining 1005.

In the description above and throughout, numerous specific details are set forth in order to provide a thorough understanding of an embodiment of this disclosure. It will be evident, however, to one of ordinary skill in the art, that an embodiment may be practiced without these specific details. In other instances, well-known structures and devices are shown in block diagram form to facilitate explanation. The description of the preferred embodiments is not intended to limit the scope of the claims appended hereto.

What is claimed is:

1. A lighting system, comprising:

a magnetic part including a magnet connected to a first fastener by a first flexible coupling; and a lighting part including a second fastener connected to a first light and a magnetic switch by a second flexible coupling, the magnetic switch assuming a conducting state when the magnetic part is beyond a threshold distance from the magnetic switch and assuming a non-conducting state when the magnetic part is within the threshold distance from the magnetic switch, wherein, when the first fastener is fastened to a first interior side of a container and the second fastener is fastened to a second interior side of the container, the first flexible coupling allows the magnetic to be oriented by gravity in a first direction and the second flexible coupling allows the first light and the magnetic switch to be oriented by gravity in the first direction such that the magnet and the magnetic switch are similarly oriented to facilitate activation of the magnetic switch.

2. The lighting system of claim 1, the magnetic switch including a reed switch, a Hall Effect sensor-based switch, or a magneto-resistive sensor-based switch.

3. The lighting system of claim 1, the first or second fastener including a clamp, a pin, or a section of adhesive tape.

4. The lighting system of claim 1, further including a first detachable shell configured to cover at least a portion of the lighting part, the first detachable shell having a first color.

5. The lighting system of claim 4, further including a second detachable shell configured to cover at least a portion of the magnetic part, the second detachable shell having the first color.

6. The lighting system of claim 5, the first and second detachable shells having a substantially cylindrical shape.

7. The lighting system of claim 5, further including an accessory kit including:

a third detachable shell configured to cover at least a portion of the lighting part, the third detachable shell having a second color;

a fourth detachable shell configured to cover at least a portion of the magnetic part, the fourth detachable shell having the second color; and a plurality of fasteners, the first and second fasteners being from the plurality, the plurality including:

first and second clamps, first and second pins, and first and second tabs with adhesive.

8. The lighting system of claim 1, the lighting part further including an extension part adding a distance between the magnetic switch and the first light, the extension part including extension wiring.

9. The lighting system of claim 8, the lighting part further including a second light, the first light and extension part being reversibly attachable to the remainder of the lighting part.

10. The lighting system of claim 1, the first fastener being attached to a first section of the magnetic piece, the magnetic piece further including a third fastener attached to a second section of the magnetic piece, the first and third fasteners cooperating to restrict movement of the magnetic piece with respect to an item when the first and third fasteners are fastened to the item.

11. A lighting system, comprising:

a first unit including:

a first flexible coupling, a first magnet, a first light, a first fastener, and a first magnetic switch, the first flexible coupling connecting the first fastener to a first assembly including the first light, the first magnet, and the first magnetic switch; and a second unit including:

a second flexible coupling, a second magnet, a second light, a second fastener, and a second magnetic switch, the second flexible coupling connecting the second fastener to a second assembly including the second light, the second magnet, and the second magnetic switch, the first magnetic switch assuming a conducting state when the second magnet is beyond a first threshold distance from the first magnetic switch and assuming a non-conducting state when the second magnet is within the first threshold distance from the first magnetic switch, and the second magnetic switch assuming a conducting state when the first magnet is beyond a second threshold distance from the second magnetic switch and assuming a non-conducting state when the first magnet is within the second threshold distance from the second magnetic switch, and wherein, when the first fastener is fastened to a first interior side of a container and the second fastener is fastened to a second interior side of the container, the first flexible coupling allows the first assembly to be oriented by gravity in a first direction and the second flexible coupling allows the second assembly to be oriented by gravity in the first direction such that the first magnet opposes the second magnetic switch across an interior of the container and the first magnetic switch opposes the second magnet across the interior of the container such that the activation of the first and second magnetic switches are facilitated when bringing the first interior side toward the second interior side.

12. The lighting system of claim 11, further including a first detachable shell configured to cover at least a portion of the first unit and a second detachable shell configured to cover at least a portion of the second unit, the first and second detachable shells having a first color.

13. The lighting system of claim 11, further including an accessory kit including:

a plurality of detachable shells each configured to cover at least a portion of the first or second units; and a plurality of fasteners, the first and second fasteners being from the plurality, the plurality including:
first and second clamps,
first and second pins, and
first and second tabs with adhesive.

14. A lighting system, comprising:

a magnetic part including a magnet connected to a first fastener by a first flexible coupling;

a lighting part including a second fastener connected to a first light and a magnetic switch by a second flexible coupling, the magnetic switch assuming an on state when the magnetic part is beyond a threshold distance from the magnetic switch and assuming an off state when the magnetic part is within the threshold distance from the magnetic switch; and a container including a first side and a second side and an interior, the first and second sides separable to form an opening allowing access to the interior, the magnetic part attached to the first side by the first fastener, the lighting part attached to the second side by the second fastener and positioned on the second side, wherein, when the first side is separated from the second side and the magnetic part is moved beyond the first threshold distance from the magnetic switch and the magnetic switch assumes the on state, the first light is in a position to illuminate at least a portion of the interior of the container, wherein the first flexible coupling allows the magnet to be oriented by gravity in a first direction and the second flexible coupling allows the first light and the magnetic switch to be oriented by gravity in the first direction such that the magnet and the magnetic switch are similarly oriented to facilitate activation of the magnetic switch.

15. The lighting system of claim 14, the lighting part further comprising a timer, the timer, when the lighting system is supplied with power, activating upon the magnetic part moving beyond the first threshold distance and, after a pre-determined time period, the timer causing a timer-controlled switch to assume an off state, the off state interrupting power supplied to the light.

16. The lighting system of claim 14, wherein the first and second flexible couplings include a swivel, a cord, or a chain, and the first and second flexible couplings are not part of a wiring system associated with powering the magnetic switch.

17. The lighting system of claim 16, the first fastener being attached to a first section of the magnetic part, the magnetic part further including a third fastener attached to a second section of the magnetic part, the first and third fasteners cooperating to restrict movement of the magnetic part with respect to the first side when the first and third fasteners are fastened to the first side, and the second fastener being attached to a first section of the lighting part, the lighting part further including a fourth fastener attached to a second section of the lighting part, the second and fourth fasteners cooperating to restrict movement of the lighting part with respect to the second side when the second and fourth fasteners are fastened to the second side.

18. The lighting system of claim 14, further including an accessory kit including:

a first detachable shell configured to cover at least a portion of the lighting part, the first detachable shell having a first color;

a second detachable shell configured to cover at least a portion of the magnetic part, the second detachable shell having the first color; and a plurality of fasteners including:
first and second clamps,
first and second pins, and
first and second tabs with adhesive, the first fastener being included in the kit as one of the plurality and the second fastener being included in the kit as one of the plurality.

* * * * *